US006341604B1

(12) United States Patent
Kellon

(10) Patent No.: US 6,341,604 B1
(45) Date of Patent: Jan. 29, 2002

(54) BALANCED BREATHING LOOP COMPENSATION RESISTIVE ALARM SYSTEM AND LUNG-INDEXED BIASED GAS ADDITION FOR ANY SEMI-CLOSED CIRCUIT BREATHING APPARATUS AND COMPONENTS AND ACCESSORIES THEREFOR

(75) Inventor: John P. Kellon, Garland, TX (US)

(73) Assignee: The Carleigh Rae Corp., Fort Lauderdale, FL (US)

( * ) Notice: Subject to any disclaimer, the term of this patent is extended or adjusted under 35 U.S.C. 154(b) by 0 days.

(21) Appl. No.: 09/003,480

(22) Filed: Jan. 6, 1998

(Under 37 CFR 1.47)

Related U.S. Application Data

(60) Provisional application No. 60/034,061, filed on Jan. 7, 1997, provisional application No. 60/034,062, filed on Jan. 7, 1997, provisional application No. 60/034,063, filed on Jan. 7, 1997, provisional application No. 60/034,064, filed on Jan. 7, 1997, provisional application No. 60/034,186, filed on Jan. 7, 1997, provisional application No. 60/034,570, filed on Jan. 7, 1997, and provisional application No. 60/055,777, filed on Jan. 7, 1997.

(51) Int. Cl.[7] ..... B63C 11/02

(52) U.S. Cl. ..... 128/201.27; 128/204.26; 128/204.28; 128/205.12; 128/205.13; 128/205.14

(58) Field of Search ..... 128/202.22, 204.26, 128/204.28, 205.12, 205.13, 205.14, 205.17, 205.28, 201.27

(56) References Cited

U.S. PATENT DOCUMENTS

| | | | | | |
|---|---|---|---|---|---|
| 3,252,458 | A | * | 5/1966 | Krasberg | 128/205.12 |
| 3,556,098 | A | * | 1/1971 | Kanwisher | 128/204.18 |
| 3,595,226 | A | * | 7/1971 | Newcombe | 128/205.12 |
| 3,672,388 | A | * | 6/1972 | Ringwall et al. | 137/88 |
| 3,695,261 | A | * | 10/1972 | Emmons | 128/204.18 |
| 3,794,021 | A | * | 2/1974 | Lambertsen | 128/204.18 |
| 3,827,432 | A | * | 8/1974 | Lindgren et al. | 128/204.18 |
| 3,951,137 | A | * | 4/1976 | Conkle et al. | 128/204.18 |
| 3,957,043 | A | * | 5/1976 | Shelby | 128/204.18 |
| 3,976,064 | A | * | 8/1976 | Wood et al. | 128/204.18 |
| 4,423,723 | A | * | 1/1984 | Winkler et al. | 128/204.18 |
| 4,440,162 | A | * | 4/1984 | Sewell et al. | 128/202.22 |
| 4,454,878 | A | * | 6/1984 | Morrison | 128/201.27 |
| 4,879,996 | A | * | 11/1989 | Harwood, Jr. et al. | 128/202.26 |
| 4,939,647 | A | * | 7/1990 | Clough et al. | 364/413.31 |
| 4,964,404 | A | * | 10/1990 | Stone | 128/204.22 |
| 4,974,585 | A | * | 12/1990 | Stone | 128/205.12 |
| 4,999,606 | A | * | 3/1991 | Comerford et al. | 340/525 |
| 5,924,418 | A | * | 7/1999 | Lewis | 128/204.22 |
| 6,003,513 | A | * | 12/1999 | Readey et al. | 128/205.24 |

* cited by examiner

*Primary Examiner*—Glenn K. Dawson
*Assistant Examiner*—Joseph F. Weiss, Jr.
(74) *Attorney, Agent, or Firm*—Malin, Haley & DiMaggio, P.A.

(57) ABSTRACT

A balanced breathing loop for a rebreather is disclosed which includes a system of components that interact to provide substantial safety and alarm awareness benefits over existing methodology in recirculating breathing apparatus loops. The device relies on a specific arrangement of components to create both automatic alternate delivery of gas to replace metabolized oxygen in case of single component failures and breathing characteristic changes that warn the user that a component failure has occurred. The breathing characteristic changes allow the user to identify which specific component has failed, thus allowing for immediate corrective action.

20 Claims, 7 Drawing Sheets

BALANCED BREATHING LOOP COMPENSATION RESISTIVE ALARM SYSTEM AND LUNG-INDEXED BIASED GAS ADDITION FOR ANY SEMI-CLOSED CIRCUIT BREATHING APPARATUS AND COMPONENTS AND ACCESSORIES THEREFOR

CROSS-REFERENCE TO RELATED APPLICATIONS

This application claims the benefit of U.S. Provisional Application No. 60/034,061, U.S. Provisional Application No. 60/034,062, U.S. Provisional Application No. 60/034,063, U.S. Provisional Application No. 60,034,064, U.S. Provisional Application No. 60/034,186, U.S. Provisional Application No. 60/034,570, and U.S. Provisional Application No. 60/035,777, all filed on Jan. 7, 1997.

STATEMENT REGARDING FEDERALLY SPONSORED RESEARCH OR DEVELOPMENT

Not applicable.

BACKGROUND OF THE INVENTION

1. Field of the Invention

The invention relates generally to rebreathers and particularly to semi-closed circuit breathing apparatuses and components and accessories therefore.

2. Description of Related Art

Conventional semi-closed rebreathers operate by delivering a premixed gas from a scuba cylinder through a constant flow regulating device, usually by supplying a regulated gas supply to a changeable orifice. Gas is delivered at a preset rate regardless of depth. The gas being breathed is recirculated, and as the oxygen within the mixture is metabolically consumed, it is hopefully being adequately replaced on a continuous basis with a predetermined continuous flow of oxygen enriched gas.

Rebreathers consist of a breathing loop from which the diver inhales and into which the diver exhales. As most of the exhaled gas stays in the breathing loop, rebreathers allow for much greater gas efficiency than open circuit systems. This greater gas efficiency allows for longer duration dives as compared to open circuit systems, or, conversely, requires less gas supply for a dive of equal duration.

The breathing loop generally includes a relief valve, scrubber, counterlung, depth equalization regulator, continuous injection system, hoses and a mouthpiece. The relief valve is utilized for dumping or venting excess gas in the breathing loop created by the rebreather on ascent and excess gas which is produced with the use of constant (active) addition systems. The scrubber cleanses the exhaled gas of carbon dioxide. The counterlung or breathing bag allows for the retention of the diver's exhalation gas. The injection system adds fresh gas to the carbon dioxide cleansed gas in the breathing loop. The depth equalization regulator adds supply mix to the loop to keep pace with depth increases. The hoses are utilized to connect the counterlung and scrubber with the mouthpiece. The mouthpiece is connected to the two hoses and is the point on the breathing loop where the diver exhales and inhales. Typically, two conventional one-way valves are incorporated into the mouthpiece.

Rebreathers normally include a harness to strap the unit to the diver, with some units also including a protective case for the various above described components.

As stated above, rebreathers generally work by recycling most of a diver's exhaled breath, which travels through the breathing loop through the scrubber, and is returned to the diver during inhalation. The use of a rebreather allows a diver to remain underwater for a relatively long time as compared to the use of open circuit equipment.

Accordingly, rebreathers allow exhaled gas to be cleansed of carbon dioxide and replenished with fresh oxygen for further consumption. A traditional fixed flow (active addition) semi-closed rebreather recycles the gas the diver is breathing, removing excess carbon dioxide from the exhaled gas and replacing it with a measured amount of premixed gas to maintain an oxygen partial pressure in the inspired gas that will continue to support metabolism.

There are several previously known types of operating systems for semi-closed circuit rebreathers, including fixed discharge ratio, continuous injection and mechanically pulsed. In the 1970's, as electronically controlled rebreathers were coming into their own, a fixed discharge ratio counterlung (an inner bellows within an outer bellows) was developed for semi-closed use in Europe. This type of rebreather was coined the first "passive" addition or counter mass ratio system. "Passive" means gas is only added as required to replace gas that has been discharged from the breathing loop by the control mechanism.

Existing rebreather designs rely on stabilizing the oxygen content of the entire breathing loop, as in FIG. 3, thus requiring higher oxygen fractions to be added and increasing the disparity between oxygen tolerance and decompression restrictions. Prior system have placed all addition functions either upstream of the scrubber or in the counterlung.

Furthermore, all prior self-contained systems use supply bottles that are plumbed inside the rebreather. The supply bottles can be mounted inside or outside the rebreather case. Additionally, all existing hose designs utilize continuous runs of highly restrictive bur flexible hose. Some are externally weighted to reduce buoyancy. Previous systems have also utilized absorbent pads or breathing bag drains to manage water entry. No dedicated disinfecting and/or drying system has previously been incorporated into a rebreather. Gas supply bottles have previously been mounted inside or outside on the base of the rebreather itself. The present invention is directed to overcoming the drawbacks of these previous designs.

BRIEF SUMMARY OF THE INVENTION

One aspect of the present invention is a rebreather design which allows for placement of the counterlung and all gas control and loop overpressure relief functions on the exhalation side of the breathing loop upstream of the carbon dioxide scrubber. The invention also provides for placement of all gas addition functions on the inhalation side of the breathing loop downstream of the carbon dioxide scrubber. The present invention also uses a desensitized demand regulator on the inhalation side of the breathing loop to relieve water ingestion and excess carbon dioxide levels caused by a partially flooded scrubber. The interaction of the components are designed to produce significant breathing characteristic changes in the event of one or more component failures that act as an alarm system.

Some of the benefits of the present invention include, but are not limited to, the following:

(1) Greatly reduces possibility of single point gas addition failures;

(2) Automatically relieves loop breathing resistance caused by scrubber flooding;

(3) Automatically relieves loss of scrubber $CO_2$ absorbent efficiency caused by scrubber flooding;

(4) Every component failure produces an unignorable breathing change that serves as an alarm that doesn't have to be monitored. This eliminates the "task overload" situation that has caused many rebreather diver deaths because various types of "indicating" alarms were either ignored or not even recognized; and (5) Prevents hypoxia through demand gas addition if systemic discharge proportions are not met by the mechanical addition system.

Accordingly, it is an object of the present invention to reduce the possibility of single point gas addition failures.

It is another object of the present invention to automatically relieve loop breathing resistance caused by scrubber flooding.

It is yet another object of the present invention to automatically relieve loss of scrubber $CO_2$ absorbent efficiency caused by scrubber flooding.

It is still another object of the present invention to produce an unignorable breathing change, for any component failure, to serve as an alarm that doesn't have to be monitored.

It is even still another object of the present invention to prevent hypoxia through demand gas addition if systemic discharge proportions are not met by the mechanical addition system.

In accordance with these and other objects which will become apparent hereinafter, the instant invention will now be described with particular reference to the accompanying drawings.

BRIEF DESCRIPTION OF THE SEVERAL VIEWS OF THE DRAWINGS

The invention may be better understood by reference to the drawings in which.

DETAILED DESCRIPTION OF THE INVENTION

Figure 1:
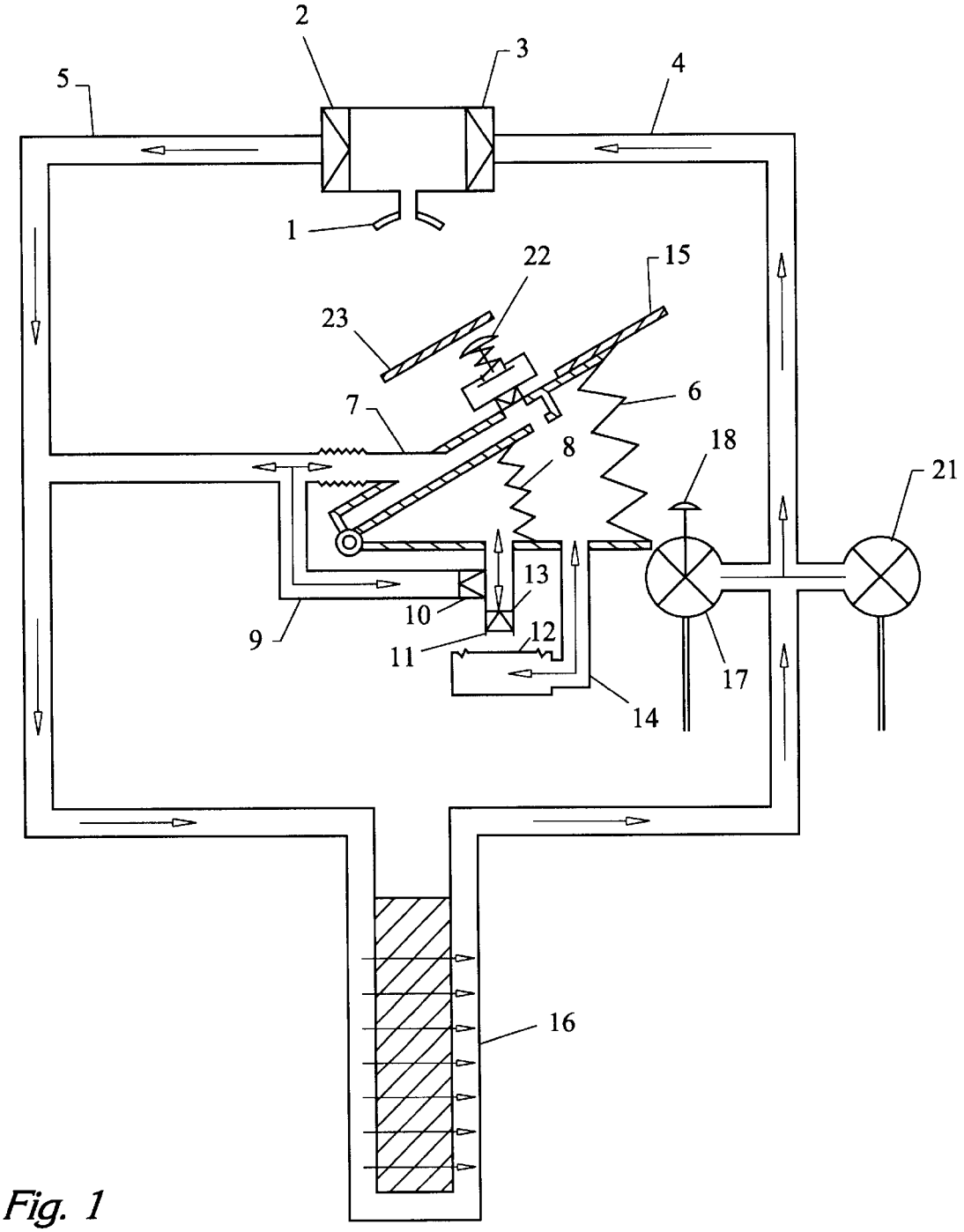
FIG. 1 is a schematic view of a balanced breathing loop in accordance with the present invention.

As seen in FIG. 1 the rebreather design provides for placement of the counterlung and all gas control and loop overpressure relief functions on the exhalation side of the breathing loop upstream of the carbon dioxide scrubber. The invention also provides for placement of all gas addition functions on the inhalation side of the breathing loop downstream of the carbon dioxide scrubber. A desensitized demand regulator is used on the inhalation side of the breathing loop to relieve water ingestion and excess carbon dioxide levels caused by a partially flooded scrubber. The interaction of the components are designed to produce significant breathing characteristic changes in the event of one or more component failures that act as an alarm system.

In operation, the diver exhales through mouthpiece 1 or other system interface device. Exhaled gases are prevented from entering inhalation side of breathing loop 4 by non-return valve 3 and directed to exhalation side of loop 5 by non-return valve 2. The exhaled gases fill the outer portion of the compound counterlung 6 through tube 7. Simultaneously being drawn inward by suction created by the rising bellows plate 15 and pushed by the positive pressure created on the exhalation side of the loop by the lungs during exhalation, the inner portion of the compound counterlung 8 fills with exhaled gases through tube 9 and non-return valve 10. Water is prevented from entering the system through tube 11 by non-return valve 13 and elastomeric diaphragm 12 which is pushed against the end of tube 11 by the positive pressure exerted against it by the exhaled gases delivered through tube 14. Because the diaphragm has several times more area than the opening at the end of tube 11, a positive seal is obtained via hydraulic advantage.

When the diver inhales, gases in the outer portion of compound counterlung 6 are draw out through tube 7 toward the lungs via the inhalation side of the breathing loop 4 and non-return valve 3 and prevented from returning through the exhalation side of the breathing loop 3 by non-return valve 2. The gases contained within the inner counterlung 8 are prevented from reentering the breathing loop by non-return valve 10 and, pushed by the collapsing outer counterlung 6, are expelled into the water through non-return valve 13 and tube 11, which is now open because diaphragm 12 has been pulled away from it by the negative pressure drawn through tube 14.

As gases are drawn into the diver's lungs through scrubber 16 and the inhalation side of the loop 4, outer counterlung 6 collapses, driving plate 15 against actuating lever 18 at the end of the inhalation. The lever actuates valve 17, adding fresh oxygen rich gas to replace the gases discharged overboard during the first part of the inhalation.

If valve 17 fails to add all or part of the replacement gas for any reason, a desensitized scuba regulator second stage 21 is actuated by the additional negative pressure at the end of the inhalation and delivers the shortfall. This condition creates an immediately noticeable difference in inhalation resistance but exhalation resistance remains normal, alerting the diver to what has occurred.

If water has entered the inner counterlung 8 or the scrubber 16 for any reason, breathing loop resistance will immediately increase on both inhalation and exhalation. The increased inhalation resistance will actuate demand regulator 21 before the compound counterlung has fully collapsed, allowing the diver to draw a full breath. When the diver exhales, there will be too much gas in the loop for the counterlung to accommodate, thus forcing overpressure relief valve 22 against a maximum travel stop 23 and discharging the excess gas. The system will automatically compensate for either type of blockage only to the degree necessary for the diver to receive a full breath, thus providing enough carbon dioxide reduction through increased gas discharge to alleviate hypercapnia problems and enough fresh gas to alleviate hypoxia problems without using any more gas supply than necessary.

Figure 2:
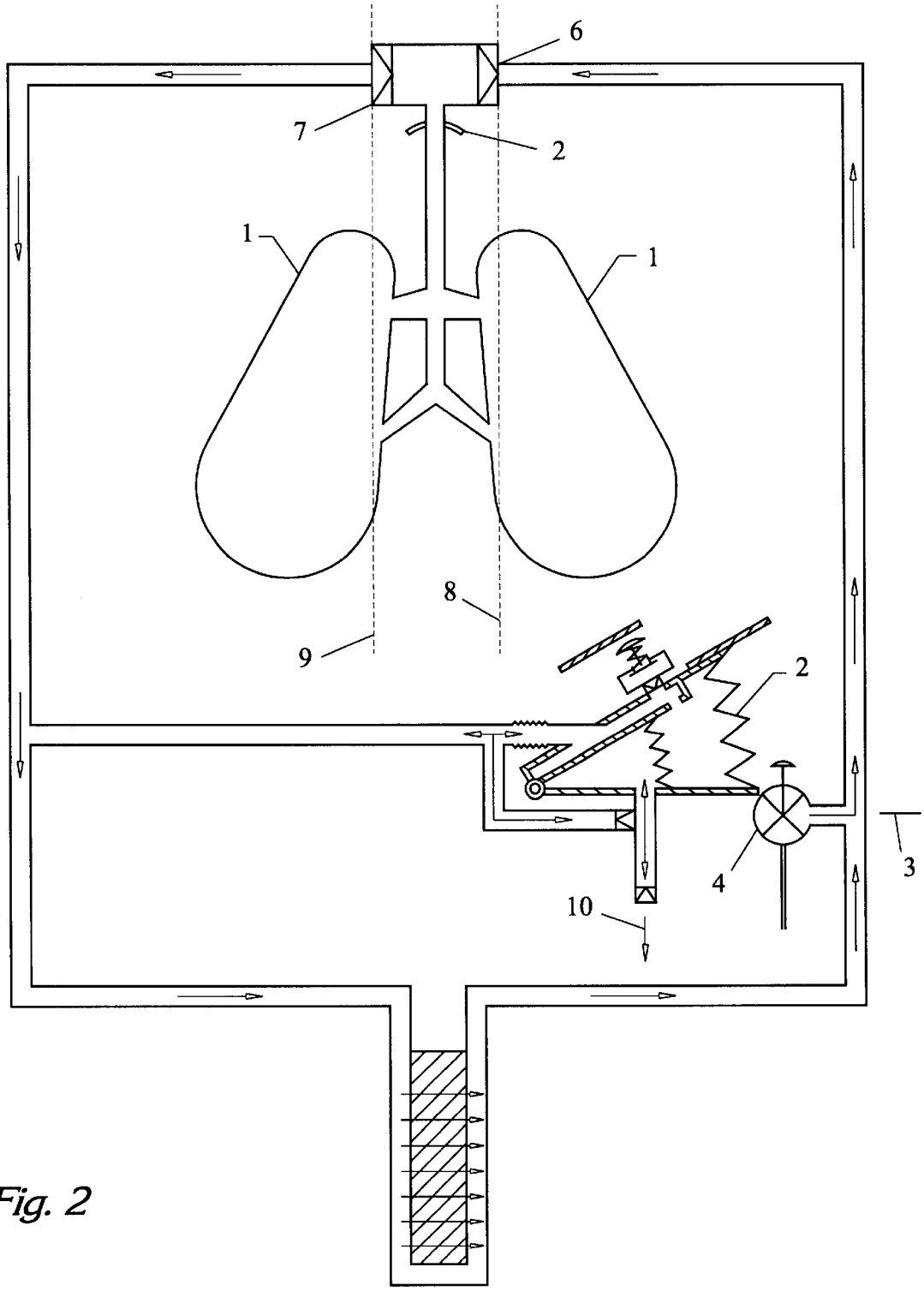
FIG. 2 is a schematic view of a breathing loop for a rebreather in accordance with the present invention.

As seen in FIG. 2, placement of the systemic metabolic replacement gas is disposed in the breathing loop to maximize its usage on the subsequent inhalation by the "active" parts of the lungs, where gas transfer to the blood stream actually takes place.

The passive semi-closed circuit breathing loop allows some of the previously exhaled gas (typically 20–25%) to be discharged from the system to ambient 40 by the collapse of the counterlung 35 during the subsequent inhalation.

Because part of the previous exhalation will not be available at the last 20–25% of the inhalation, the almost fully collapsed counterlung triggers addition valve 34, which Baked up the volumetric difference with fresh supply gap. The addition point for the makeup gas 33 is placed so that the entire addition remains in the inhalation part of the breathing loop 30 between the addition point and inhalation non-return valve 36 with the entire addition being as close to valve 36 as possible without going beyond it.

On the next inhalation, the lungs 31 first inspire the contents of the pendulum part of the loop, the space bounded by dotted lines Be and 39. This space consists of the respiratory deadspace contained in the trachea, bronchia, etc. and the deadspace contained in the interface device between the mouth at 2 and non-return valves 36 and 37 Typically, the pendulum deadspace totals approximately 0.35 liter, though the invention is not limited to such amount.

Using approximate volumes and based on a 25discharge/addition, if the respiratory tidal volume is 1 liter, the inspired breath will consist of the 0.35 liter pendulum volume, 0.25 liter fresh gas, and 0.4 liter gas from the unenriched part of the breathing loop, of which 0.35 liters remains in the pendulum deadspace to be the first part of the subsequent exhalation. Thus, approximately 38.5% of the new alveolar gas contact is with fresh gas. The inspired gas is further diluted in the lungs by approximately 1 liter of residual deadspace gas.

If the tidal volume is 3 liters, the inspired breath will consist of the 0.35 liter pendulum volume, 0.75 liter fresh gas, and 1.9 liters from the unenriched part of the breathing loop, of which 0.35 liters retains in the pendulum deadspace to be the first part of the subsequent exhalation. Thus, approximately 28.3% of the new alveolar gas contact is with fresh gas. The inspired gas is further diluted in the lungs by approximately 1 liter of residual deadspace gas. The difference in percentage of fresh gas alveolar contact percentage is made up for by the other component of respiratory minute volume, number of breaths per minute.

Using standard addition methods, the new alveolar gas contact would be 5–15%, depending on the breathing loop volume. The same amount of oxygen replenishment will be available, but the inspired oxygen fractions will be lower because the fresh gas will have been diluted by all or a large part of the volume of the breathing loop. Some of the benefits include, but are not limited to, the following:

(1) Dilution of the higher oxygen partial pressure of the "makeup" or metabolic sustenance gas by the exhaled gases (lower oxygen partial pressure because of metabolic consumption) is minimized;

(2) Alveolar contact with the fresh gas addition on each breath is maximized, thus producing a net inspired oxygen fraction that is as close as possible to the supply gas oxygen fraction;

(3) The maintenance of e higher inspired oxygen fraction relative to the supply as oxygen fraction reduces the time and depth disparities for oxygen tolerance and decompression requirements between open circuit and semi-closed circuit underwater breathing systems; and (4) In semi-closed underwater breathing systems, the maintenance of an inspired oxygen fraction closer to the supply gas oxygen fraction permits a larger depth range for safe open circuit bailouts using the same supply gas without the occurrence of oxygen toxicity problems.

Thus, the invention discloses a method of adding metabolic sustenance gas to a semi-closed circuit breathing loop in such a manner as to avoid diluting the addition with the contents of the "dead" space of the loop and respiratory system, thus assuring maximum alveolar contact with and usage of the added oxygen partial pressure.

Figure 3:
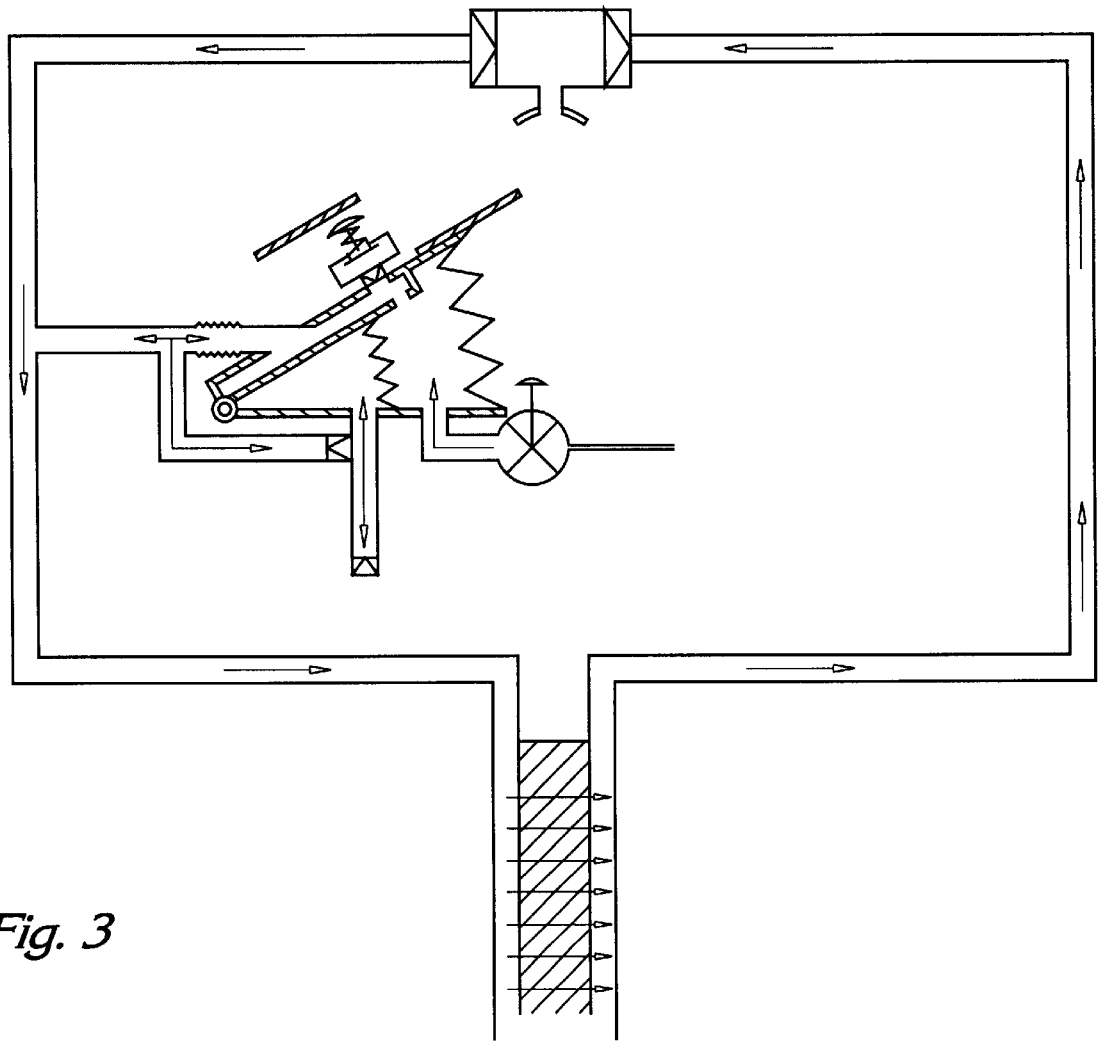
FIG. 3 is a schematic view of a breathing loop for a rebreather.
Figure 4:
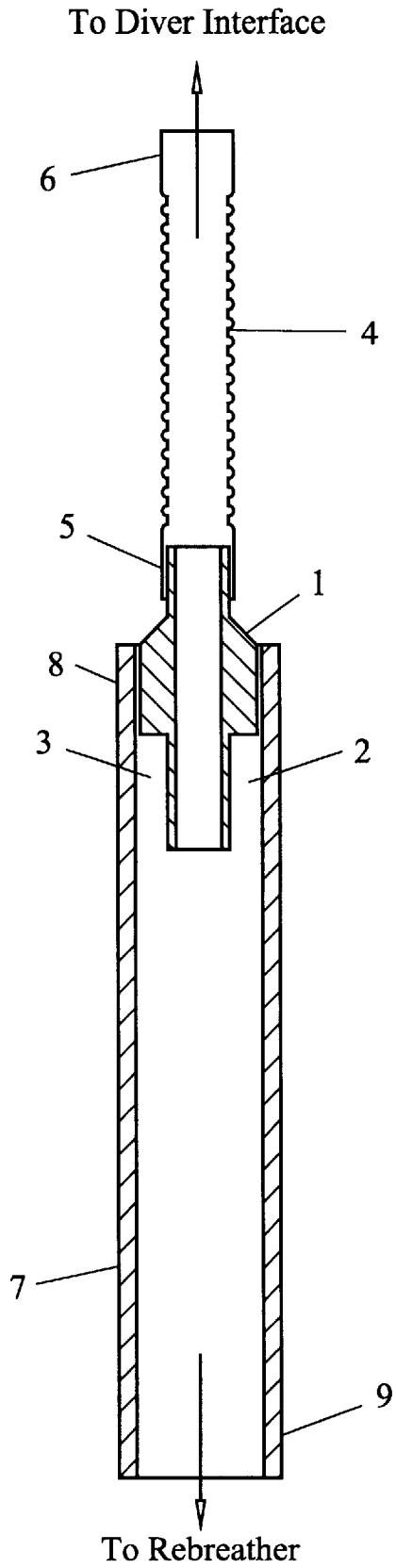
FIG. 4 is a sectional view of a portion of a compound breathing hose in accordance with the present invention.

FIG. 3 shows another breathing loop configuration 41 for a rebreather. As seen in FIG. 4, a compound breathing hose with a water trap for rebreathers is disclosed. The compound hose uses two different types of breathing hose in each hose assembly. Use of a connector between hose types is also provided that traps water away from the diver interface. The hose connector sized and/or weighted to reduce hose assembly buoyancy.

In operation, on the inhalation side, breathing gases enter the smooth bore, low flow resistance large diameter semi-flexible elastomeric hose 57 at 59. The gases proceed to the diver through weighted fitting 51, while fluid borne caustic scrubber products are trapped by space 53 between hose 57 and fitting extension 52.

Gases are passed to the diver interface through flexible corrugated hose 54, which is attached to weighted fitting 51 at point 55 and the intake side of the interface at point 56, and is only long enough to allow diver head movement without placing vertical or side loads on the interface device. Reduction of the length of this hose to the minimum required for free head movement produces a corresponding reaction in internal gas flow resistance and external water flow resistance associated with this type of highly flexible hose.

On the exhalation side, gases are returned to the rebreather through flexible hose 54, weighted fitting 55, and semi-flexible hose 57. Any water introduced to the gases through interface mismanagement are prevented from returning to the interface by space 53 between fitting extension 52 and semi-flexible hose 57, Some of the benefits include, but are not limited to, the following:

(1) Prevents diver ingestion of caustic scrubber fluids produced during rebreather operation;

(2) Prevents water introduced through the diver interface from gurgling against the exhalation valve;

(3) Reduces internal gas flow resistance;

(4) Reduces external drag on hoses at high propulsion speeds while using a diver propulsion vehicle; and (5) Eliminates strain at the interface caused by hose assembly buoyancy.

Thus, a breathing hose is provided which is intended to be used in pairs to connect a recirculating breathing apparatus to a diver interface. Thus breathing hose reduces gas resistance on the inside, water resistance on the outside, and water intrusion to the diver, and hose buoyancy.

Figure 5:
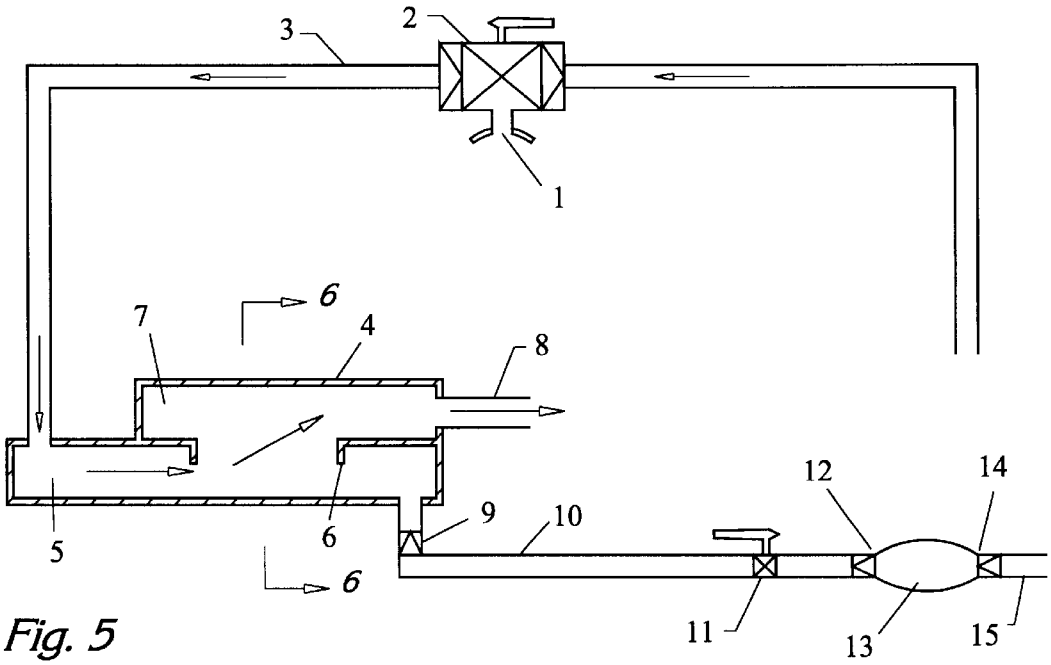
FIG. 5 is a schematic view of a rebreather water separator and evacuation system in accordance with the present invention.
Figure 6:
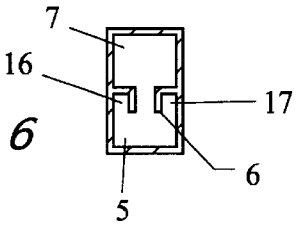
FIG. 6 is a sectional view taken along line A—A of FIG. 5.

As seen in FIGS. 5 and 6 a rebreather water separator and evacuation system in accordance with the present invention is illustrated. The system includes a dual chamber water separator that allows breathing gases to continue to the rest of the breathing loop while trapping water. A non-return valve passes the trapped water to a sump and prevents it from returning to the separator. A sump is provided to extend the water holding capacity of the system. A hand operated pump is also provided to evacuate the contents of the sump at any time during the dive. Furthermore, a hand valve is also provided to prevent overboard gas losses between evacuations.

Where a diver inadvertently admits water to the breathing loop through mouthpiece 61 while valve 62 is open, water and exhalation gapes enter exhalation hose 63 The gases and water then enter separator 64 through chamber 65. The gases enter chamber 67 through water dam 66. Water is prevented from entering chamber 67 by water dam 66, which traps water even in an inverted position in areas 76 and 77. The water enters sump 70 through non-return valve 69, which is located in the part of chamber 65 that is normally lowest when the diver is swimming or working.

When valve 71 is opened, sump 70 can be evacuated through outlet 75 to ambient either by repeatedly squeezing elastomeric bulb 73 and alternately operating non-return valves 72 and 74 or utilizing the excess breathing loop pressure produced on ascent. Some of the benefits include, but are not limited to, the following:

(1) Traps large amounts of water that would normally flood the scrubber;

(2) Permanently removes water from the breathing loop;

(3) Can be repeatedly flooded and evacuated during the dive;

(4) Can be evacuated during ascents by simply opening the evacuation valve; and (5) Eliminates gurgling noises associated with diver interface mismanagement.

Thus, the water separator and evacuation system provides a means for trapping water that is inadvertently admitted to a rebreather breathing loop through diver interface mismanagement, such as dropping the mouthpiece without closing the mouthpiece valve.

Figure 7:
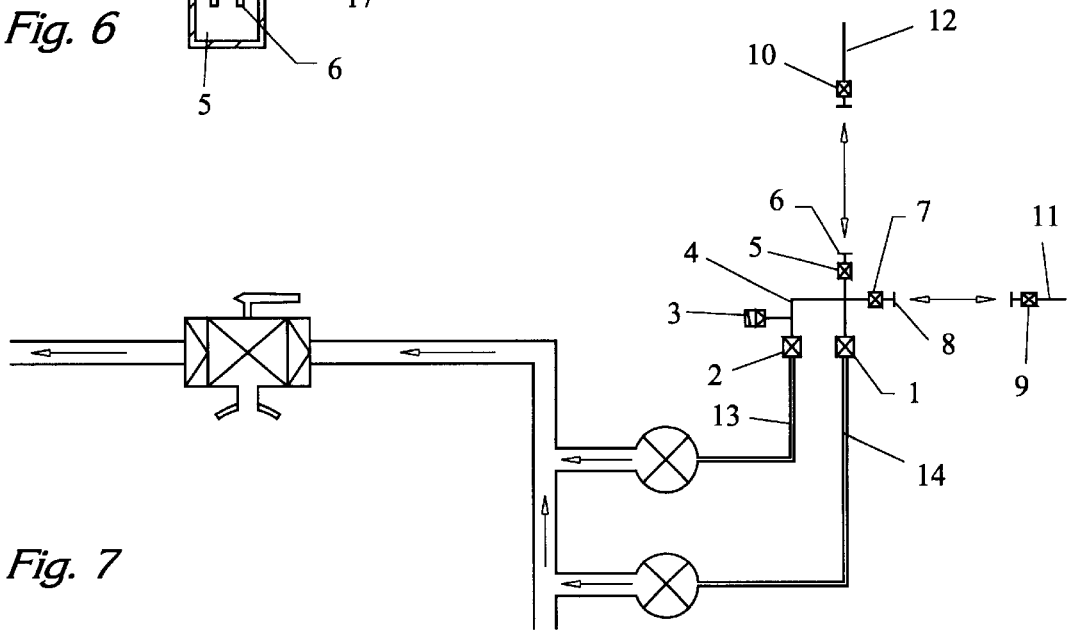
FIG. 7 is a schematic view of an external semi-closed circuit rebreather control system in accordance with the present invention.

As seen in FIG. 7, an external semi-closed circuit rebreather control system is illustrated. The control system includes dual internal orifice or regulator supply valves, dual double shutoff quick disconnects mounted 90 degrees apart, and supply valves common to both quick disconnects. An overpressure relief valve common to all components is also provided. Internal supply hoses are routed outside of the rebreather case. The system does not use an internal gas supply.

In operation, the diver selects the appropriate gas supply from external Source 91 or 92 and plugs the proper pelf-opening quick disconnect 89 or 90 into socket 88 or 86 with self-opening valves 87 or 85. The supply gas enters manifold 84 which is common to all adjacent components 81, 82, 83, 85, and 87. Either supply valve 81 or 82 can be opened to allow flow through hoses 93 or 94, or both can be opened if one hose supplies a backup regulator. Either can be closed to stop gas losses from a leaking or free-flowing regulator. If both supply valves 81 and 82 are closed when an external source with creeping regulator pressure is connected, the excess pressure will be vented by overpressure relief valve 83 to prevent the Supply hose(s) from bursting. Some of the benefits include, but are not limited to, the following:

(1) No internal high pressure gas leaks that cannot be detected by the diver until he loses his gas supply;

(2) Quick disconnects cannot be mistaken for one another;

(3) Either of two orifices or regulators can be externally selected;

(4) Overpressures from external supply gas regulators are relived if both orifice valves are closed; and (5) Different gas supply mixes can be selected and plugged in during the dive, including decompression gases. Thus, the external semi-closed circuit rebreather control system provides a means for controlling either an active or passive addition system through an external control block and associated valving.

Figure 8:
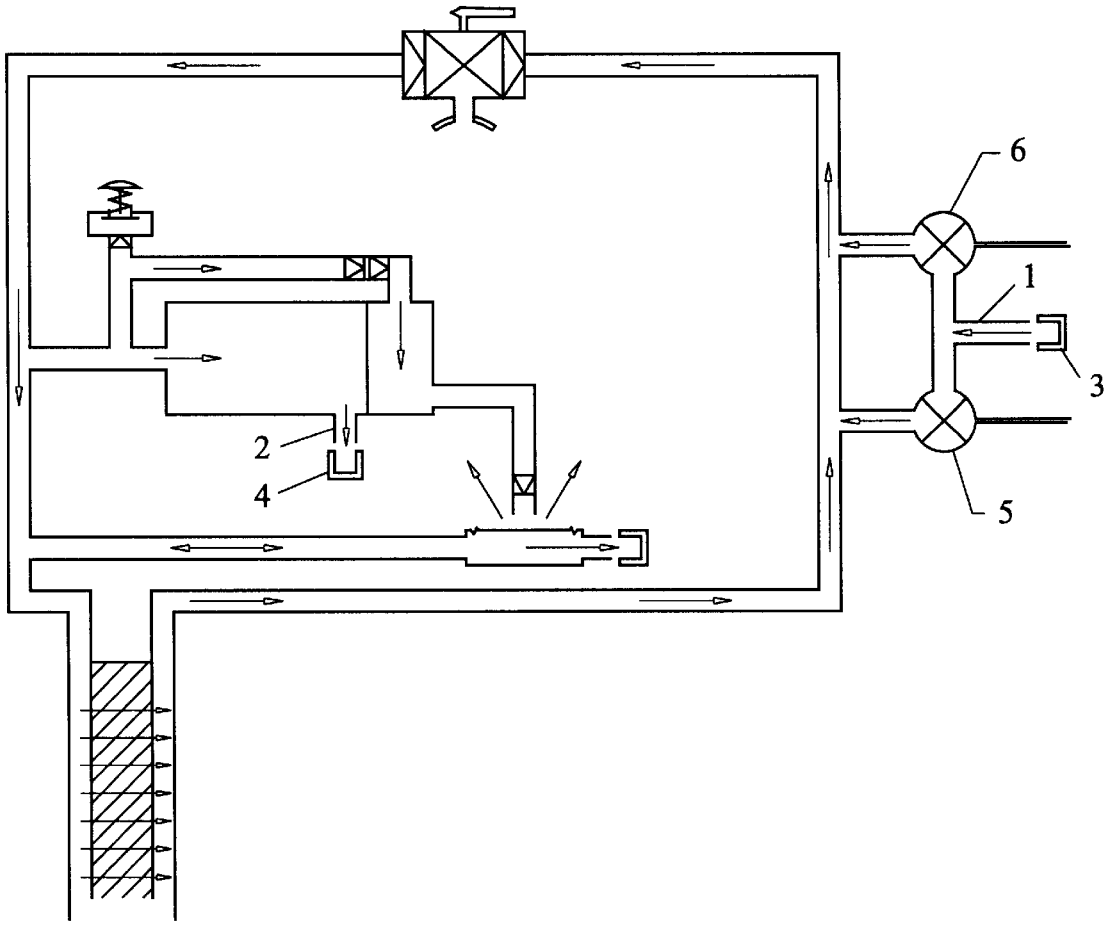
FIG. 8 is a schematic view of a rebreather disinfecting and drying system in accordance with the present invention.

As seen in FIG. 8, a rebreather disinfecting and drying system is illustrated. The system includes an entry port for the introduction of disinfectants and drying air that has a removable cap. Exit ports, having removable caps, are also provided at the end of every non-recirculating passage in the breathing loop.

In operation, caps 103, 104, and 108 are removed from inlet port 101 and outlet ports 102 and 107. Rebreather is rotated until inlet port 101 is the lowest point in the system. Disinfectant is pumped into the breathing loop through inlet port 101. Outlet ports 102 and 107 are each capped after disinfectant escapes from them. Rebreather is rotated until inlet port 101 is the highest point in the system. Disinfectant flow is stopped and cap 103 is installed on inlet 101. Rebreather is rotated through three axes and allowed to sit for at least 30 minutes. All ports 101, 102, and 107 are then uncapped. Rebreather is then rotated through three axes until disinfectant has been drained. A low pressure air blower is attached to inlet port 101 and turned on. The blower is allowed to run until breathing loop is dry, then it is removed. Afterwards, all ports 101, 102, and 107 are capped. Some of the benefits include, but are not limited to, the following:

(1) Completely eliminates bacterial proliferation in the breathing loop; and (2). Allows for thorough flushing of salt water or other contaminants from the breathing loop.

Thus, the rebreather disinfecting and drying system provides a means for more effectively accomplishing disinfecting and drying operations in the breathing loop by eliminating "dead ends."

Figure 9:
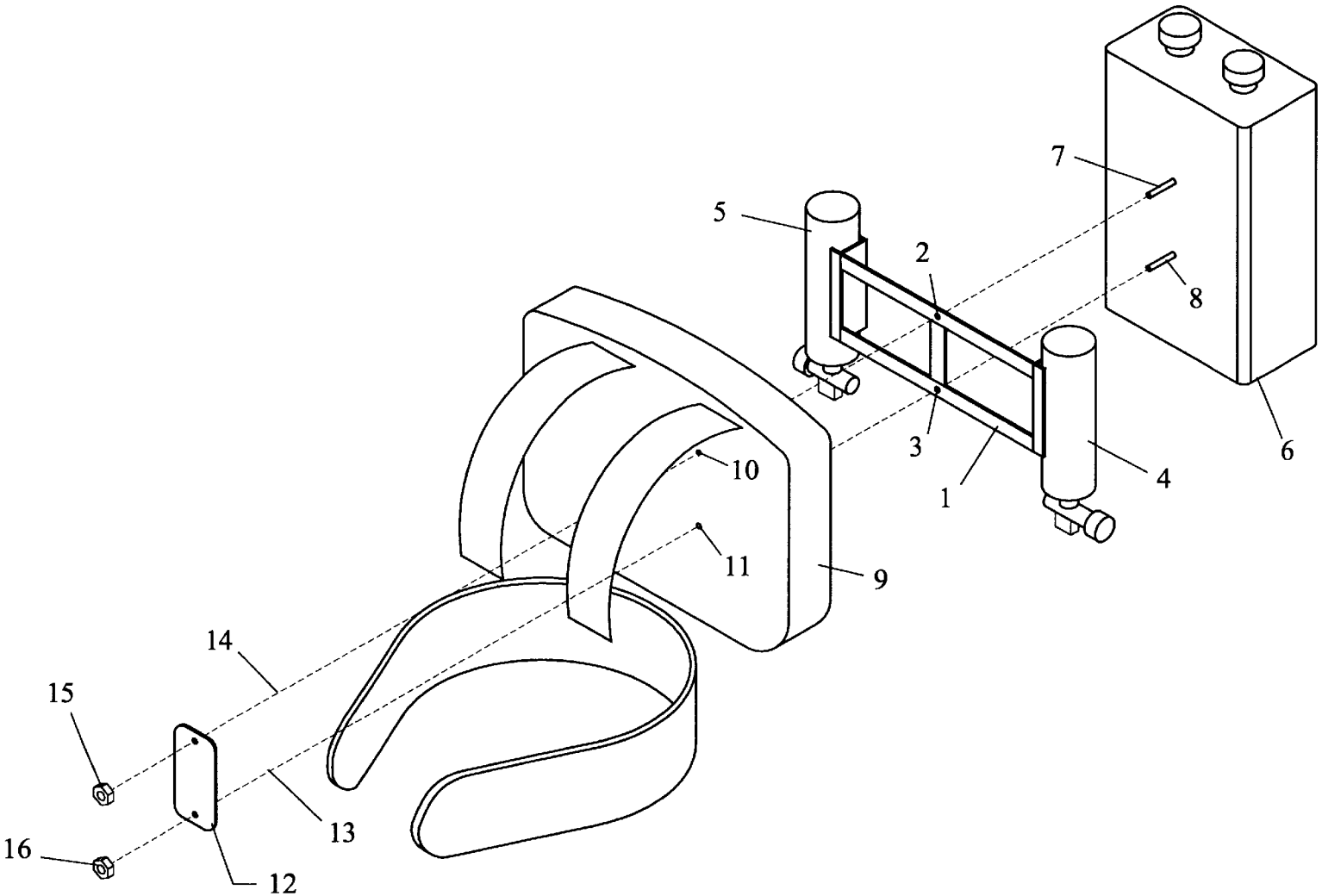
FIG. 9 is an isometric exploded view of a removable tank rack for rebreathers.

As seen in FIG. 9, a gas supply bottle frame that sandwiches between the rebreather and backplate or buoyancy control device (whichever incorporates the diver harness) and is held in place by the same attachment components. The gas supply bottle assemblies are preconfigured by mounting the desired components such as bottles 114 and 115 and associated manifolding to removable frame 111.

The required assembly is attached to the rebreather 116 by sliding frame mounting holes 112 and 113 over mounting bolts 117 and 118, Buoyancy control device 119 is mounted over removable frame 111 by sliding mounting holes 120 and 121 over mounting bolts 117 and 118 Backplate 122 is mounted over buoyancy control device 119 by sliding mounting holes 123 and 124 over mounting bolts 117 and 118. Nuts 125 and 126 are tightened onto mounting bolts 117 and 11E, rigidly securing the stacked components. Removal of the gas bottle assembly on rack 111 after the dive is Accomplished in reverse order. The assembly allows depleted bottle configurations to be easily removed as a unit for transport to a gas filling facility, thus eliminating the need to transport the entire rebreather. The assembly also allows rapid change of preconfigured bottle arrangemnents or bottle assemblies with differing oxygen and inert gas fractions. Thus, a removable tank rack for rebreathers is disclosed which provides a means for quickly removing gas supply bottle configurations from rebreathers in order to install another premounted configuration or fill the existing configuration without having to handle the rebreather in the process.

Applicant also incorporates by reference the disclosure of its co-pending application entitled Variable Volume Ratio Compound Counterlung which was filed on Jan. 6, 1998, U.S. application Ser. No. 09/003,409.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A balanced breathing loop for a rebreather, comprising:

a scrubber;

a system interface member;

an exhalation side having a first end and a second end, a first end of said exhalation side communicating with said system interface member and a second end of said exhalation side communicating with said scrubber;

an inhalation side having a first end and a second end, a first end of said inhalation side communicating with said system interface member and a second end of said inhalation side communicating with said scrubber; and a counterlung having an outer portion and an inner portion;

a gas control member;

loop overpressure relief member;

wherein said counterlung, said gab control member and said loop overpressure relief member are disposed on the exhalation side upstream of said scrubber;

a gas addition member are disposed on the inhalation side downstream of said scrubber.

2. The balanced breathing loop of claim 1 further including a demand regulator communicating with the inhalation side.

3. The balanced breathing loop of claim 2 wherein said demand regulator is desensitized.

4. The balanced breathing loop of claim 2 wherein said demand regulator is actuated by an additional negative pressure at an end of a user's inhalation which also creates a noticeable difference in inhalation resistance to the user.

5. The balanced breathing loop of claim 3 wherein said demand regulator relieves water ingestion and excess carbon dioxide levels caused by a partially flooded scrubber.

6. A balanced breathing loop for a rebreather, comprising:

a breathing loop having an exhalation side and an inhalation side;

a first one-way valve disposed within said breathing loop, said first one-way valve defining a first point of said exhalation side;

a second one-way valve disposed within said breathing loop, said second one-way valve defining a first point of said inhalation side;

a system interface member in communication with said breathing loop between said first one-way valve and said second one-way valve;

a counterlung having an outer portion and an inner portion;

a first passageway having a first end and a second end, said first passageway in communication with said exhalation side at its first end and in communication with said outer portion of said counterlung at its second end;

a second passageway having a first end and a second end, said second passageway in communication with said first passageway at the first end of said second passageway;

a third passageway having a first end and a second end, said second passageway in communication with said third passageway at the second end of said second passageway, said third passageway in communication with said inner portion of said counterlung at the first end of said second passageway;

a third one-way valve disposed within said second passageway approximate its second end;

a fourth one-way valve disposed within said third passageway approximate its second end;

a scrubber in communication with said breathing loop, said scrubber defining a second point of said exhalation side and a second point of said inhalation side; and means for supplying additional gas to said breathing loop under certain conditions.

7. The balanced breathing loop of claim 6 wherein said system interface member is a mouthpiece.

8. The balanced breathing loop of claim 6 wherein said first passageway is a first tube-like member, said second passageway is a second tube-like member, and said third passageway is a third tube-like member.

9. The balanced breathing loop of claim 6 wherein said means for supplying additional gas comprises:

a valve/gas supply member in communication with said inhalation side, said supply member including an actuating lever; and a contact member connected to said outer portion of said counterlung;

wherein during inhalation by a user said contact member contacts said actuating lever to deliver gas from said valve/gas supply member to the inhalation side of said breathing loop.

10. The balanced breathing loop of claim 9 wherein said means for supplying additional gas further comprises:

a fourth passageway having a first end and a second end; said fourth passageway in communication with said outer portion of said counterlung at its first end; and a diaphragm in communication with said fourth passageway and connected to the fourth passageway at the second end of said fourth passageway;

wherein during exhalation by a user said diaphragm expands to seal said second end of said third passageway.

11. The balanced breathing loop of claim 9 further including a regulator in communication with said inhalation side.

12. The balanced breathing loop of claim 9 wherein said contact member is a bellow plate.

13. The balanced breathing loop of claim 6 further including an overpressure relief valve in communication with said outer portion of said counterlung.

14. The balanced breathing loop of claim 14 further a include, stop member defining a maximum travel distance for said overpressure relief valve.

15. The balanced breathing loop of claim 6 wherein the additional gas is an oxygen rich gas.

16. The balanced breathing loop of claim 6 wherein said means for supplying additional gas comprises:

a valve/gas supply member in communication with said outer portion of said counterlung, said supply member including an actuating lever; and a contact member connected to said outer portion of said counterlung;

wherein during inhalation by a user said contact member contacts said actuating lever to deliver gas from said valve/gas supply member to said outer portion of said counterlung.

17. The balanced breathing loop of claim 6 further including a water separator and evacuation system in communication with said exhalation side of said breathing loop.

18. A balanced breathing loop for a rebreather, comprising:

a breathing loop having an exhalation side and an inhalation side;

a first one-way valve disposed within said breathing loop, said first one-way valve defining a first point of said exhalation side;

a second one-way valve disposed within said breathing loop, said second one-way valve defining a first point of said inhalation side;

a mouthpiece in communication with said breathing loop between said first one-way valve and said second one-way valve;

a counterlung having an outer portion and an inner portion;

an overpressure relief valve in communication with said outer portion of said counterlung;

a first tube-like member having a first end and a second end, said first tube-like member in communication with said exhalation side at its first end and in communication with said outer portion of said counterlung at its second end;

a second tube-like member having a first end and a second end, said second tube-like member in communication with said first tube-like member at the first end of said second tube-like member;

a third tube-like member having a first end and a second end, said second tube-like member in communication with said third tube-like member at the second end of said second tube-like member, said third tube-like member in communication with said inner portion of said counterlung at the first end of said second tube-like member;

a third one-way valve disposed within said second tube-like member approximate its second end;

a fourth one-way valve disposed within said third tube-like member approximate its second end;

a scrubber in communication with said breathing loop, said scrubber defining a second point of said exhalation side and a second point of said inhalation side; and means for supplying additional gas to said breathing loop under certain conditions.

19. The balanced breathing loop of claim 18 wherein said means for supplying additional gas comprises:

a valve/gas supply member in communication with said inhalation side, said supply member including an actuating lever;

a bellow plate connected to said outer portion of said counterlung;

a fourth tube-like member having a first end and a second end; said fourth tube-like member in communication with said outer portion of said counterlung at its first end;

a diaphragm in communication with said fourth tube-like member and connected to the fourth tube-like member at the second end of said fourth tube-like member; and a regulator in communication with said inhalation side;

wherein during inhalation by a user said bellow plate contacts said actuating lever to deliver gas from said valve/gas supply member to the inhalation side of said breathing loop;

wherein during exhalation by a user said diaphragm expanding to seal said second end of said third tube-like member.

20. The balanced breathing loop of claim 18 further a include stop member defining a maximum travel distance for said overpressure relief valve.

* * * * *